US009803479B2

(12) United States Patent
Hall et al.

(10) Patent No.: US 9,803,479 B2
(45) Date of Patent: Oct. 31, 2017

(54) END RING DEGRADATION PICK SUPPORT

(71) Applicant: Novatek IP, LLC, Provo, UT (US)

(72) Inventors: David R. Hall, Provo, UT (US); Ronald B. Crockett, Spring City, UT (US); Dwain Norris, Spanish Fork, UT (US)

(73) Assignee: NOVATEK IP, LLC, Provo, UT (US)

( * ) Notice: Subject to any disclaimer, the term of this patent is extended or adjusted under 35 U.S.C. 154(b) by 0 days.

(21) Appl. No.: 14/806,264

(22) Filed: Jul. 22, 2015

(65) Prior Publication Data

US 2016/0024919 A1 Jan. 28, 2016

Related U.S. Application Data

(60) Provisional application No. 62/029,370, filed on Jul. 25, 2014.

(51) Int. Cl.

| | |
|---|---|
| ***E21C 35/18*** | (2006.01) |
| ***E21C 35/19*** | (2006.01) |
| ***E21C 27/24*** | (2006.01) |
| ***E01C 23/088*** | (2006.01) |
| ***E21C 35/183*** | (2006.01) |
| ***E21C 25/10*** | (2006.01) |

(52) U.S. Cl.

CPC ..... *E21C 35/183* (2013.01); *E21C 25/10* (2013.01); *E21C 27/24* (2013.01); *E21C 35/18* (2013.01); *E21C 35/19* (2013.01); *E01C 23/088* (2013.01); *E21C 2035/191* (2013.01)

(58) Field of Classification Search

CPC .... E21C 25/10; E21C 35/19; E21C 2035/191; E21C 35/18; E21C 27/24; E01C 23/088; E01C 23/127

See application file for complete search history.

(56) References Cited

U.S. PATENT DOCUMENTS

| | | | | | |
|---|---|---|---|---|---|
| 3,512,838 | A | * | 5/1970 | Kniff | E21C 35/19 299/104 |
| 3,652,130 | A | * | 3/1972 | Elders | E21C 35/19 175/354 |
| 3,904,246 | A | * | 9/1975 | Gandy | E21C 35/23 175/213 |
| 4,119,350 | A | * | 10/1978 | Sander | E21C 25/10 175/394 |
| 4,219,239 | A | | 8/1980 | Weikert et al. | |
| 4,225,190 | A | | 9/1980 | Hoffmann | |
| 4,244,626 | A | * | 1/1981 | Konieczny | E21C 25/10 175/404 |
| 4,249,779 | A | | 2/1981 | Best et al. | |
| 4,358,161 | A | | 11/1982 | Needham | |

(Continued)

*Primary Examiner* — David Bagnell
*Assistant Examiner* — Michael Goodwin

(57) ABSTRACT

In such fields as road milling, mining and trenching it is often desirable to engage and degrade tough materials such as asphalt, concrete and rock. To do so, degradation picks comprising hardened tips may be secured to an exterior of a rotatable drum so as to be repeatedly brought into contact with a surface of a material to be degraded. To secure such degradation picks to the rotatable drum, a toroidal body comprising an interior surface rigidly attachable to the rotatable body and an exterior surface comprising a plurality of bore holes disposed there around may receive a plurality of degradation picks secured within the bore holes.

17 Claims, 4 Drawing Sheets

(56) References Cited

U.S. PATENT DOCUMENTS

| | | | | |
|---|---|---|---|---|
| 4,394,053 | A | 7/1983 | Schupphaus | |
| 4,411,475 | A | 10/1983 | Best et al. | |
| 4,451,092 | A | 5/1984 | Best et al. | |
| 4,491,370 | A | 1/1985 | Best et al. | |
| 5,230,548 | A * | 7/1993 | Southern | E21C 35/19 299/104 |
| 5,374,111 | A * | 12/1994 | Den Besten | E21C 35/18 299/106 |
| 6,779,850 | B1 | 8/2004 | Schibeci et al. | |
| 8,911,024 | B2 | 12/2014 | Fundakowski et al. | |
| 2002/0030085 | A1* | 3/2002 | Sollami | B23K 1/0008 228/132 |
| 2012/0280559 | A1* | 11/2012 | Watson | E21C 35/18 299/106 |

* cited by examiner

END RING DEGRADATION PICK SUPPORT

CROSS REFERENCE TO RELATED APPLICATIONS

This patent application claims priority to U.S. Provisional Pat. App. No. 62/029,370 entitled "End Ring for a Degradation Drum" and filed Jul. 25, 2014, which is incorporated herein by reference for all that it contains.

BACKGROUND OF THE INVENTION

Degradation picks are known to be used in such fields as road milling, mining and trenching to engage and degrade tough materials such as asphalt, concrete and rock. Such degradation picks may be secured to an exterior of a rotatable drum so as to be repeatedly brought into contact with a surface of a material to be degraded. Each degradation pick may comprise a hardened tip designed for repeated impact with a tough material. Such repeated impact may break up the tough material into aggregate pieces. To secure such degradation picks to a rotatable drum, a generally cylindrical shank opposite the hardened tip may be disposed within a bore within a block that is rigidly fixed to the drum.

It may be desirable to position additional degradation picks in strategic locations around a rotatable drum. For example, the ends of a rotatable drum when viewed along a rotational axis thereof may engage tough materials not only around a perimeter of the drum but also beyond the end of the drum. In such cases, it may be desirable to position additional degradation picks proximate the end of the drum to engage this additional material.

Additional degradation picks may be disposed proximate an end of a drum by attaching a ring to an end of a drum to hold additional degradation pick blocks. For example, U.S. Pat. No. 4,225,190 to Hoffmann describes a mining auger which is used in the underground mining of coal comprising an end ring along its outer periphery. A plurality of tool holders is provided along a free edge of the end ring. The longitudinal axis of each tool holder coincides with the longitudinal axis of each cutting tool bit arranged in the respective tool holder.

By way of another example, U.S. Pat. No. 4,411,475 to Best et al. describes a cutting drum for an extracting machine assembled of a base body having a frustoconical configuration and an end ring which is detachably mounted to a major end face of the base body. The end ring is provided along its periphery with a plurality of tool holders for accommodating picks.

Despite these advancements in the art, the need for even tighter formations of degradation picks than those possible by arranging tool holders around the periphery of an end ring is still desirable. This is because each of the tool holders occupies a given footprint thus limiting the number that may fit in any defined area.

BRIEF SUMMARY OF THE INVENTION

A degradation pick support may comprise a toroidal body comprising an interior surface and an exterior surface. The interior surface may be rigidly attachable to a rotatable body. The exterior surface may comprise a plurality of bore holes disposed there around. A plurality of degradation picks may be secured within the bore holes.

The toroidal body may be secured to a rotatable body that may be generally cylindrical, conical or frustoconical in shape. The toroidal body may be coaxial with the rotatable body and be secured proximate an end of the rotatable body along a rotational axis thereof. A portion of the exterior surface facing the rotatable body may be substantially planar while another portion of the exterior surface facing opposite the rotatable body may be substantially curved.

The plurality of bore holes may be disposed around the toroidal body in a helical pattern. Further, in various embodiments, the rotatable body may comprise a generally helical flange disposed around an exterior thereof wherein the flange may be substantially the same height off of the rotatable body as the toroidal body in a direction normal to an exterior of the rotatable body. The plurality of bore holes may be disposed in a pattern continuing from the helical flange.

At least one of the bore holes may comprise an interior surface material tougher than a remainder of the toroidal body. In various embodiments, replaceable sleeves may be placed within the bore holes or the bore holes may each comprise a counter bore sufficiently large to encompass a degradation pick secured within the bore hole. Also, the toroidal body may be formed of a unitary mass.

Each of the plurality of degradation picks may comprise a hardened tip opposite a shank. Each shank may be disposed within an individual bore hole. When the toroidal body is secured to a rotatable body, a hardened tip of at least one of the plurality of degradation picks may extend beyond an end of the rotatable body along a rotational axis thereof. In specific embodiments, several of the plurality of picks, evenly distributed among the plurality of picks, may comprise hardened tips extending beyond the end of the rotatable body along a rotational axis thereof. The rotatable body may further comprise a plurality of blocks secured thereto with a plurality of degradation picks substantially similar to the plurality of degradation picks secured within the bore holes secured within the blocks.

DETAILED DESCRIPTION OF THE DRAWINGS

Figure 1:
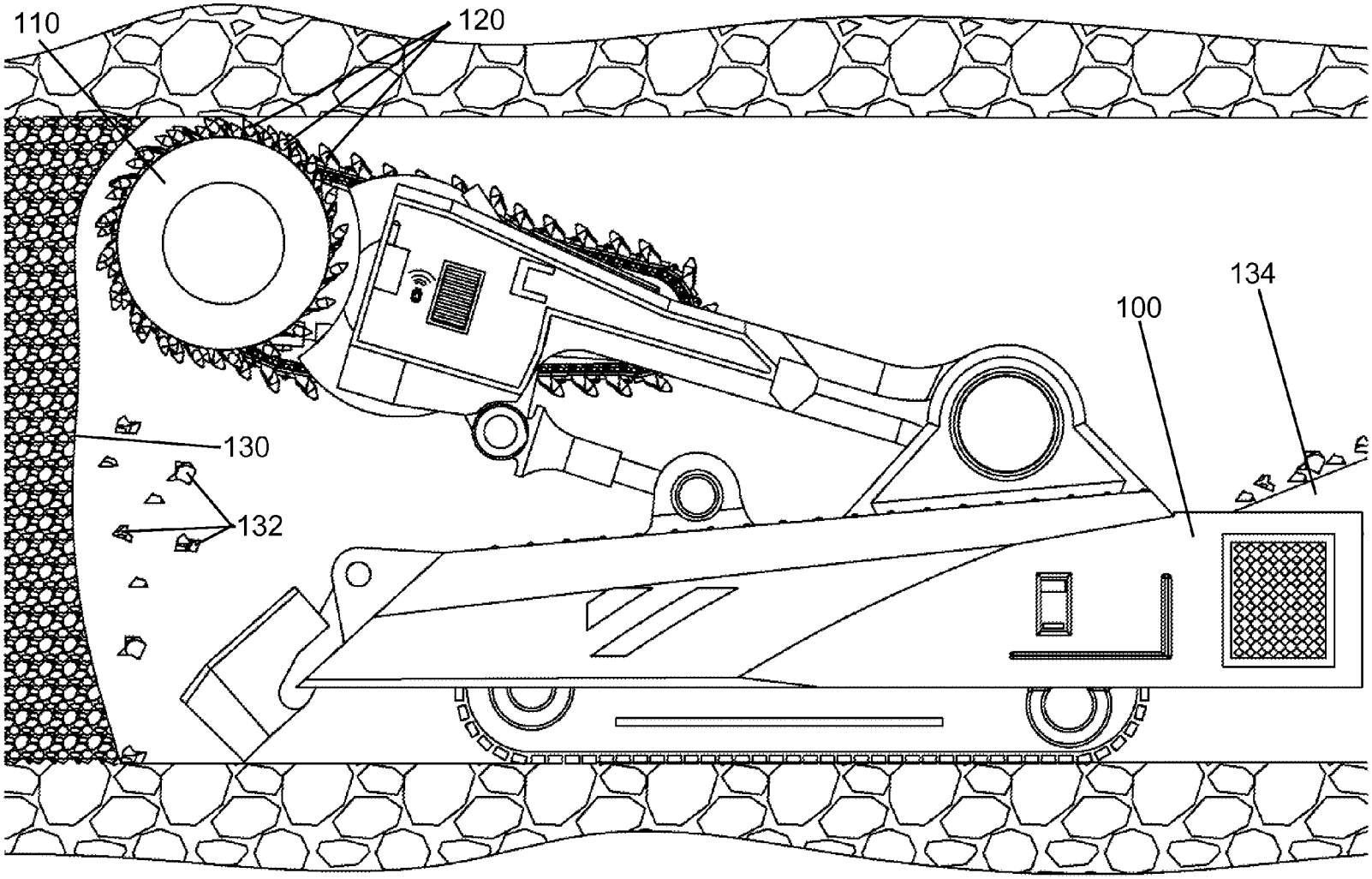
FIG. 1 is an orthogonal view of an embodiment of a formation degradation machine, one of a variety of styles used in such fields as road milling, mining and trenching to engage and degrade tough materials such as asphalt, concrete and rock.

FIG. 1 shows an embodiment of a formation degradation machine 100, one of a variety of styles used in such fields as road milling, mining and trenching to engage and degrade tough materials such as asphalt, concrete and rock. The formation degradation machine 100 may comprise a rotatable drum 110 that may be rotated about a central axis by the formation degradation machine 100. The rotatable drum 110 may be formed in any of a variety of shapes with generally cylindrical, conical or frustoconical being particularly useful.

A plurality of degradation picks 120 may be secured to an exterior of the rotatable drum 110. As the rotatable drum 110 is rotated the degradation picks 120 may be repeatedly brought into contact with a surface of a material 130 to be degraded. Such repeated impact may break up the material 130 into aggregate pieces 132 that may be removed by a conveyor 134.

Figure 2:
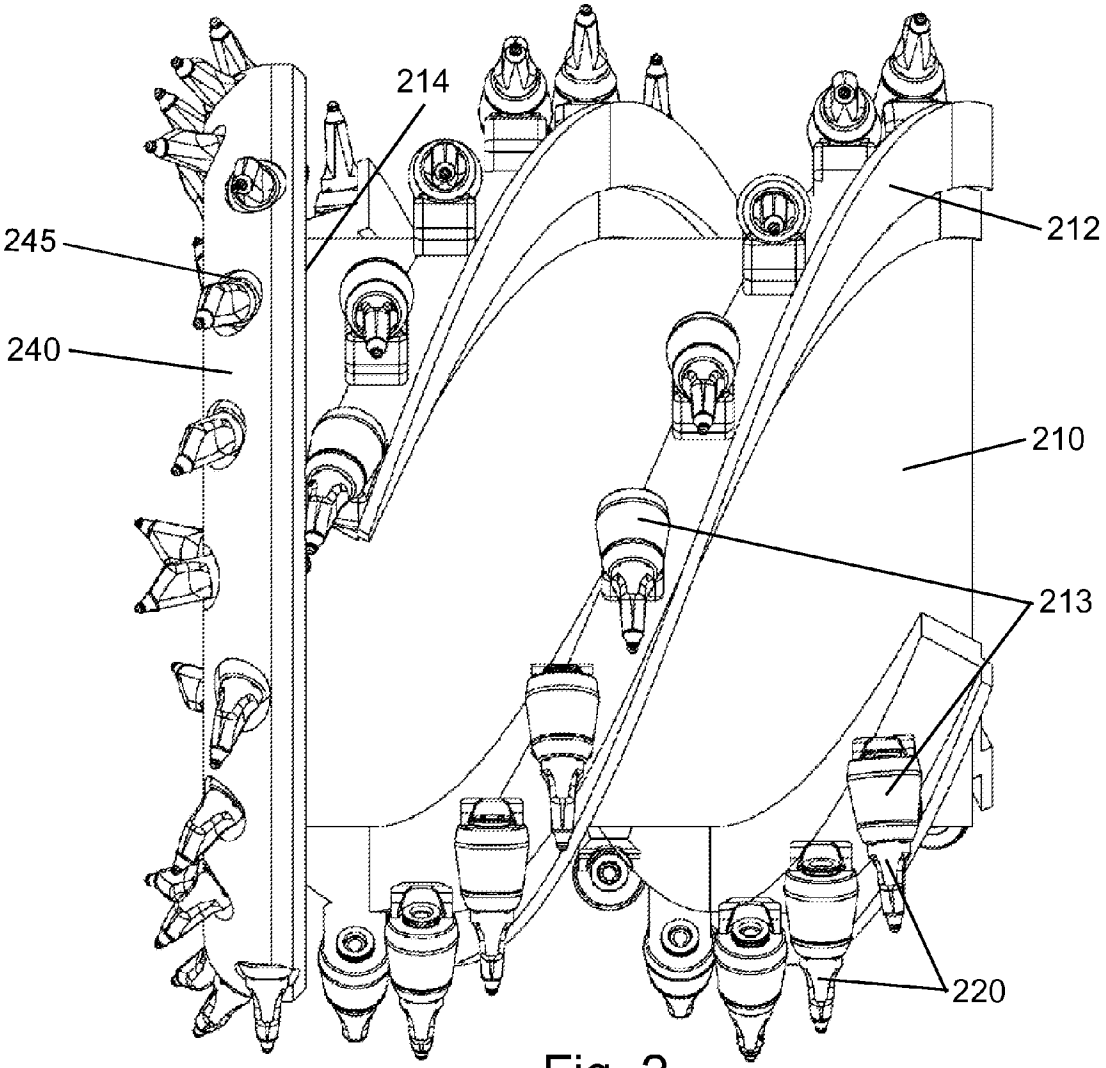
FIG. 2 is an orthogonal view of an embodiment of a rotatable body comprising a plurality of degradation picks secured thereto that may be repeatedly brought into contact with a material to be degraded as the rotatable body is rotated.

FIG. 2 shows an embodiment of a rotatable drum 210 comprising a plurality of degradation picks 220 secured thereto. The rotatable drum 210 may comprise a generally helical flange 212 disposed around an exterior thereof. Some of degradation picks 220 may be disposed within blocks 213 secured to the flange 212. A toroidal shaped support 240 may be attached to the rotatable drum 210 proximate an end 214 thereof and positioned coaxial therewith. A plurality of bore holes (hidden) may be disposed around an exterior of the toroidal shaped support 240. In the embodiment shown, a replaceable sleeve 245 is disposed within each of the plurality of bore holes. Each replaceable sleeve 245 may receive one of the degradation picks 220. The bore holes may be disposed around the toroidal shaped support 240 in a helical pattern. In various embodiments, the helical flange 212 may be substantially the same height off of the rotatable drum 210 as the toroidal shaped support 240 in a direction normal to an exterior of the rotatable drum 210. Further, the helical pattern of the bore holes around the toroidal shaped support 240 may continue from that of the helical flange 212. It is believed that such a helical pattern may aid in channeling aggregate pieces of material away from the degradation picks 220 point of impact.

In various embodiments, some of the degradation picks 220 secured to the toroidal shaped support 240 may extend beyond the end 214 of the rotatable drum 210 along a rotational axis thereof. In the embodiment shown in FIG. 2, several of the degradation picks 220, evenly distributed among the degradation picks 220, extend beyond the end 214 of the rotatable drum 210.

Figure 3:
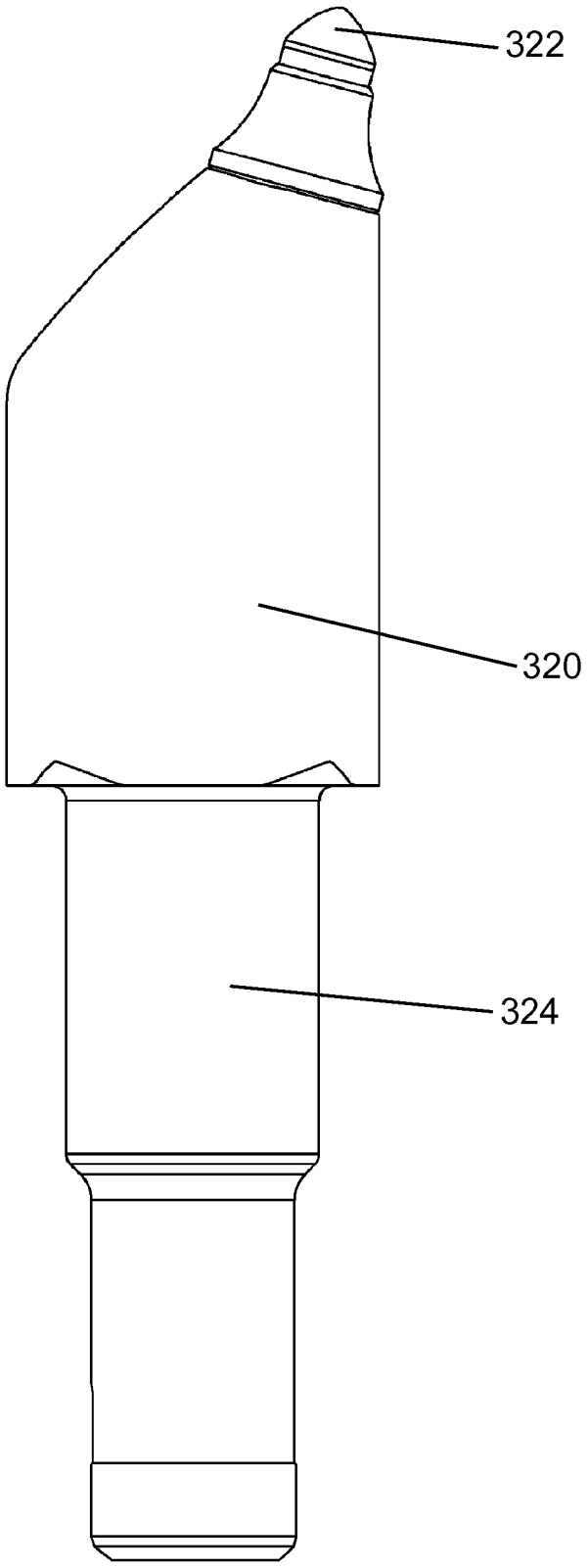
FIG. 3 is an orthogonal view of an embodiment of a degradation pick comprising a hardened tip designed for repeated impact with a tough material opposite a generally cylindrical shank to secure the degradation pick to a rotatable body.

FIG. 3 shows an embodiment of a degradation pick 320 comprising a hardened tip 322 designed for repeated impact with a tough material. To secure the degradation pick 320 to a rotatable drum, a generally cylindrical shank 324 disposed opposite the hardened tip 322 may be inserted into a bore hole of a block or support that may be rigidly fixed to the drum.

Figure 4:
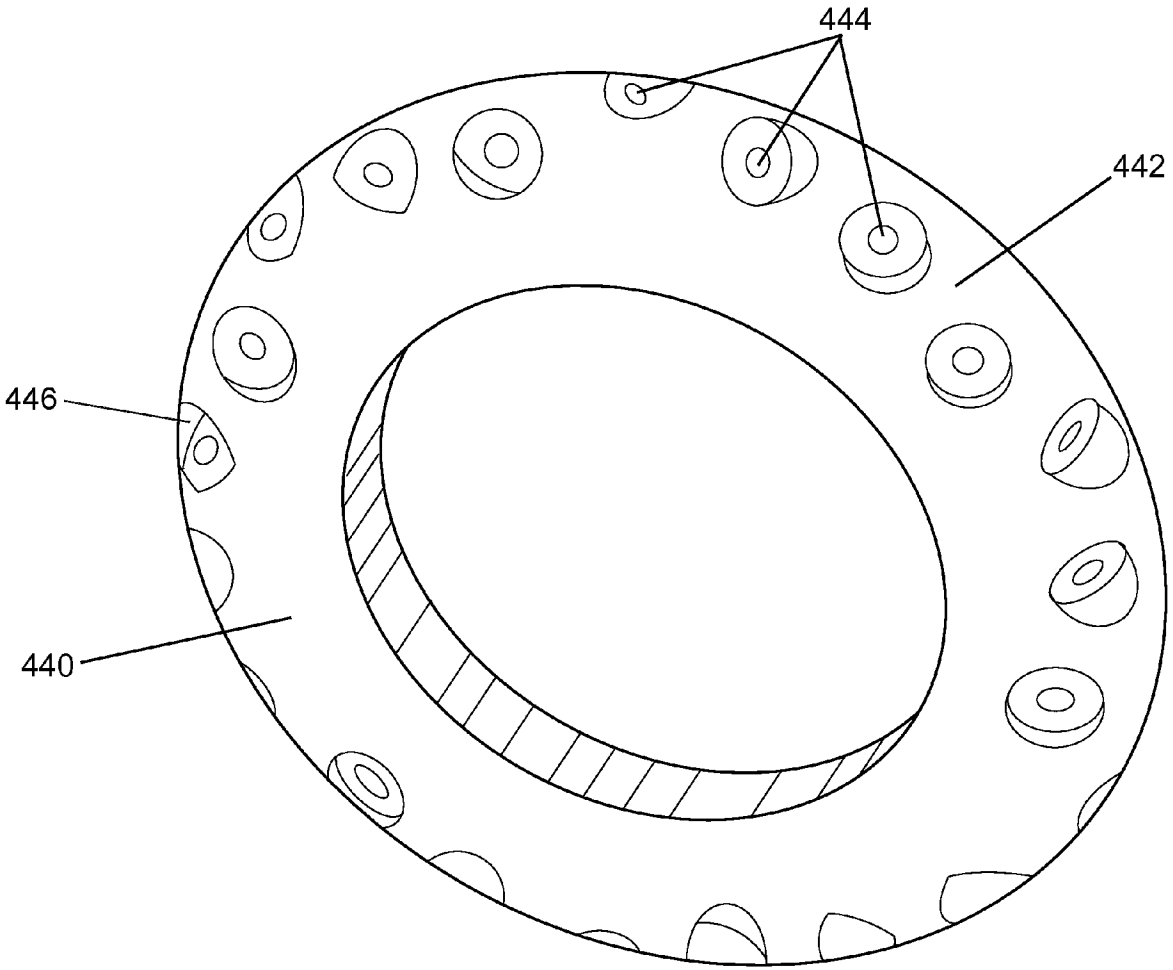
FIG. 4 is a perspective view of an embodiment of a degradation pick support comprising a toroidal body and a plurality of bore holes disposed around an exterior thereof.

FIG. 4 shows an embodiment of a degradation pick support 440 comprising a toroidal body 442 formed of a unitary mass. A plurality of bore holes 444 may be disposed around an exterior of the toroidal body 442. To protect the toroidal body 442 from wear, in some embodiments, the bore holes 444 may comprise an interior surface material tougher than a remainder of the toroidal body 442. In various embodiments, the plurality of bore holes 444 may each comprise counter bores 446 sufficiently large to encompass a degradation pick.

Whereas the present invention has been described in particular relation to the drawings attached hereto, it should be understood that other and further modifications apart from those shown or suggested herein, may be made within the scope and spirit of the present invention.

The invention claimed is:

1. A degradation pick support, comprising:

a toroidal body comprising an interior surface and an exterior surface;

a rotatable body comprising a generally helical flange disposed around an exterior surface of the rotatable body, wherein:

the helical flange is a same height off the exterior surface of the rotatable body as the toroidal body is off the exterior surface of the rotatable body, measured in a direction normal to the exterior surface of the rotatable body; and the rotatable body is rigidly secured to the toroidal body, with the interior surface of the toroidal body being rigidly secured to the rotatable body; and a plurality of bore holes disposed around the exterior surface of the toroidal body.

2. The degradation pick support of claim 1, wherein the toroidal body has a rotational axis extending therethrough, wherein the toroidal body is coaxial with the rotatable body about the rotational axis.

3. The degradation pick support of claim 1, wherein the rotatable body is generally cylindrical, conical or frustoconical.

4. The degradation pick support of claim 1, wherein the toroidal body is secured proximate an end of the rotatable body along a rotational axis thereof.

5. The degradation pick support of claim 4, wherein a portion of the exterior surface facing axially toward the generally helical flange is planar.

6. The degradation pick support of claim 5, wherein another portion of the exterior surface facing opposite the generally helical flange is curved.

7. The degradation pick support of claim 1, wherein the plurality of bore holes are disposed in a pattern continuing from the helical flange.

8. The degradation pick support of claim 1, wherein the plurality of bore holes are disposed around the toroidal body in a helical pattern.

9. The degradation pick support of claim 1, wherein at least one of the bore holes comprises an interior surface material tougher than a remainder of the toroidal body.

10. The degradation pick support of claim 1, further comprising a replaceable sleeve disposed within at least one of the bore holes.

11. The degradation pick support of claim 1, further comprising a plurality of degradation picks secured within the bore holes.

12. The degradation pick support of claim 11, wherein each of the plurality of degradation picks comprises a hardened tip opposite a shank and each shank is disposed within an individual bore hole.

13. The degradation pick support of claim 12, wherein a hardened tip of at least one of the plurality of degradation picks extends beyond an end of the rotatable body along a rotational axis thereof.

14. The degradation pick support of claim 13, wherein several of the plurality of picks, evenly distributed among the plurality of picks, comprise hardened tips extending beyond the end of the rotatable body along a rotational axis thereof.

15. The degradation pick support of claim 11, wherein the rotatable body comprises a plurality of blocks secured thereto and a second plurality of degradation picks similar to the plurality of degradation picks secured within the bore holes are secured within the blocks.

16. The degradation pick support of claim 1, wherein the toroidal body is formed of a unitary mass.

17. The degradation pick support of claim 1, wherein at least one of the plurality of bore holes comprises a counter bore sufficiently large to encompass a degradation pick secured within the bore hole.

* * * * *